US007153817B2

(12) United States Patent
Binder

(10) Patent No.: US 7,153,817 B2
(45) Date of Patent: Dec. 26, 2006

(54) DETERGENT TABLET

(75) Inventor: Christopher James Binder, North Shields (GB)

(73) Assignee: The Procter & Gamble Company, Cincinnati, OH (US)

( * ) Notice: Subject to any disclaimer, the term of this patent is extended or adjusted under 35 U.S.C. 154(b) by 490 days.

(21) Appl. No.: 10/204,877

(22) PCT Filed: Feb. 20, 2001

(86) PCT No.: PCT/US01/05396

§ 371 (c)(1),
(2), (4) Date: Aug. 23, 2002

(87) PCT Pub. No.: WO01/62886

PCT Pub. Date: Aug. 30, 2001

(65) Prior Publication Data

US 2003/0032568 A1 Feb. 13, 2003

(30) Foreign Application Priority Data

Feb. 23, 2001 (GB) ..... 0004130.1

(51) Int. Cl.
*C11D 17/00* (2006.01)
*C11D 3/06* (2006.01)

(52) U.S. Cl. ..... 510/226; 510/224; 510/220

(58) Field of Classification Search ..... 510/114, 510/191, 224, 220, 226
See application file for complete search history.

(56) References Cited

U.S. PATENT DOCUMENTS

| | | | | |
|---|---|---|---|---|
| 4,460,490 | A | 7/1984 | Barford et al. | |
| 4,465,612 | A | 8/1984 | Altenschopfer et al. | |
| 5,733,859 | A | 3/1998 | Carrie et al. | |
| 5,877,132 | A * | 3/1999 | Callaghan et al. | 510/114 |
| 5,981,449 | A | 11/1999 | Rapisarda et al. | |
| 6,274,538 | B1 * | 8/2001 | Addison | 510/224 |

FOREIGN PATENT DOCUMENTS

| | | |
|---|---|---|
| EP | 0 612 843 A1 | 8/1994 |
| EP | 0 496 188 B1 | 10/1997 |
| EP | 0 851 023 A2 | 7/1998 |
| EP | 0 601 990 B1 | 10/1998 |
| EP | 1 061 123 A1 | 12/2000 |
| GB | 1 307 387 | 2/1973 |

* cited by examiner

*Primary Examiner*—Yogendra N. Gupta
*Assistant Examiner*—Preeti Kumar
(74) *Attorney, Agent, or Firm*—Armina E. Matthews; Ian S. Robinson; Laura R. Grunzinger

(57) ABSTRACT

A machine cleaner tablet comprising from about 10 to about 75% of a limescale remover acid, from about 1 to about 20% of low foaming non-ionic surfactant, from about 0.5 to about 5% of a detergency enzyme and wherein the tablet has a pH measured as a 1% solution in distilled water at 20° C. in the range from about 1 to about 5. The tablet is used for cleaning the interior of automatic dishwashers, food processing machines and the like.

15 Claims, No Drawings

DETERGENT TABLET

TECHNICAL FIELD

The present invention relates to compositions for cleaning the interior of automatic dishwashers, food processing machines and the like. More specifically, the invention relates to acidic cleaning compositions containing enzymes to remove limescale, food and detergent residues.

BACKGROUND

The surface of the interior of dishwashers becomes covered with residues over the course of time. The kind of residues found most frequently are: limescale, soap scum and food deposits. Limescale is formed from the insolubilisation of ions contained in tap water. The limescale deposits in the dishwashing interior especially in the heater elements of the dishwasher. Such deposits are undesirable not only from the aesthetic aspect but also because they can interfere with the heat exchange process and this results in less efficient use of energy. The soap scums are remnants from the detergents. The food deposits mainly consist of finely divided fatty food residues and they are usually found in the filter giving it a greasy appearance.

Some dishwashing interior cleaning compositions have been formulated, however they are mainly aimed at limescale removal rather than the removal of greasy residues. These compositions moreover, are generally in the form of liquids or granules. Tablets are considered a more convenient form, however, a dishwasher interior cleaner in tablet form is not apparently known in the art. It is understood that cleaning compositions in tablet form hold several advantages over cleaning compositions in particulate form, such as ease of dosing, handling, transportation and storage. Therefore, there is a need for a dishwashing interior cleaning compositions in tablet form.

The use of acidic cleaning compositions to remove limescale is well-known in the art (See for example U.S. Pat. No. 5,733,859, EP-A-0,496,188 and EP-A-0,601,990). U.S. Pat. No. 5,877,132 discloses an aqueous cleaning composition for removing limescale from surfaces wherein said composition comprises a biodegradable aqueous acidic system, preferably a surfactant and additional components selected from thickeners, co-builders and enzyme mixtures. Said enzyme mixtures comprises carbohydrase and gluconase enzymes. Liquid and granular acidic compositions are traditionally used to clean the interior of automatic dishwashers. EP-A-0,256,148 discloses a cleaner composition for dishwashing machine interiors comprising citric acid and low-foaming non-ionic surfactant. U.S. Pat. No. 5,981,449 discloses an aqueous cleaning composition for removing limescale in automatic dishwashers and laundry machines. The cleaning composition comprises maleic acid and an acid-stable thickener. U.S. Pat. No. 4,465,612 describes a process for cleaning and maintaining dishwashing interiors. The cleaning composition is a liquid containing an acid, an alcohol a low-sudsing non-ionic surfactant and customary additives.

EP-A-0,612,843 discloses a process for granulating acidic crystalline material. The granules are used in formulating a granular acidic cleaner used to clean dishwashing machine interiors. The cleaning compositions may be in unit-dose twin-compartment pack form comprising a weak organic acid such as citric acid, non-ionic surfactant, a strong organic acid, such as sulphamic and a perfume.

The present invention thereafter provides machine cleaner in tablet form having improved cleaning performance on machine filters as well as good limescale removal performance and product stability.

SUMMARY OF THE INVENTION

The compositions according to the present invention are designed to clean machine interiors. They are presented in the form of a tablet, comprising from about 10 to about 75% of a limescale remover acid, from about 1 to about 20% of low foaming non-ionic surfactant, from about 0.5 to about 5% of a detergency enzyme and wherein the tablet has a pH measured as a 1% solution in distilled water at 20° C. in the range from about 1 to about 5, but more preferably in the range from about 2 to about 4.

In preferred embodiments of the invention the limescale remover acid is selected from the group consisting of water soluble organic mono- and polycarboxylic acids with two to six carbon atoms in the molecule and which have a pKa value, related to the first dissociation stage of less than about 6. In general terms, limescale remover acids suitable for use herein are crystalline in form and have an weight average particle size from about 100 μm to about 500 μm and preferably from about 200 μm to about 400 μm. The preferred limescale remover is citric acid. The limescale remover acid is generally present in a level from about 25% to about 65%, preferably from about 40% to about 60% by weight of the tablet.

In preferred embodiments of the invention the non-ionic surfactant is selected from: poly(oxyalkylated) alcohols (eg: ethoxylated alcohols, ethoxylated/propoxylated alcohols), end-capped poly(oxyalkylated) alcohols, alkylene oxide condensates with propylene glycol or alkylene diamine adducts and mixtures thereof. The non-ionic surfactant is typically present at a level of from about 1% to about 20% by weight, more preferably from about 2% to about 18% by weight, most preferably from about 4% to about 15% by weight of composition.

Enzymes suitable for use herein include those conventionally used in dishwashing compositions as well as enzymes having optimum efficacy in an acid regime. It is surprising that enzymes that traditionally have been used in automatic dishwashing compositions (having a typical alkaline pH between 9 and 11) have good grease-removal performance under the cleaning conditions of the invention (strong acidic medium with a typical pH between 2 and 4). In one aspect of the invention, therefore, enzymes having an optimum enzyme stability in the pH range from about 5 to about 11, preferably from about 7 to about 10 are used. Preferably, such enzymes are selected from proteases, α-amylases and mixtures thereof, highly preferred being an α-amylase derived from *Bacillus licheniformis*.

The tablet of the invention can additionally comprise one or more components selected from: builders, aesthetic agents, polymeric dispersants, disrupting agents, binders, dissolution retardant agents, shine improvement agents, residuality improvement agents and mixtures thereof.

Processing of the tablet compositions herein raises a number of problems. On one hand, the low-foaming non-ionic surfactant is generally liquid at ambient temperatures; on the other, the limescale remover acid is generally crystalline in form and free of pores, therefore difficult to bind because the binding forces between the crystals and the liquid are not strong enough. According to the present invention, a surfactant carrier is required to help achieve optimum product stability. In a preferred embodiment from about 5% to about 60%, preferably from about 10% to about 50% of a surfactant carrier is used. Controlling the particle size both of the limescale remover acid and of the surfactant carrier is also important for achieving optimum stability. In a preferred embodiment the particle size of the limescale remover acid is in the range from about 100 μm to about 500 μm and more preferably from about 200 μm to about 400 μm while the weight average particle size of the surfactant carrier is less than about 70 μm and more preferably less than about 20 μm. The preferred carrier herein is selected from alkali metal salts of strong acids, polymeric disintegrants and mixtures thereof. Especially preferred is sodium sulphate.

The tablet can be prepared by pre-mixing all the components and compressing the mixture in a tablet press. According to another embodiment the tablet can be prepared by preagglomeration of the non-ionic surfactant and the carrier, admixing the limescale remover acid and detergency enzyme and compressing the mixture in a tablet press. Alternatively, the non-ionic surfactant can be preagglomerated with the carrier and acid.

The present invention also encompasses a cleaning method for dishwasher and washing machine interiors, said method comprising placing the tablet of the invention in the machine interior, e.g., in the case of a dishwasher in the cutlery basket, and running the unloaded machine at high or a low temperature washing program.

DETAILED DESCRIPTION OF THE INVENTION

The compositions according to the present invention are designed for cleaning machine interiors. The essential components of the composition are a limescale remover acid, a non-ionic surfactant and a detergency enzyme. The composition is presented in the form of tablet, having a pH, measured as a 1% solution in distilled water at 20° C., in the range from about 1 to about 5.

Limescale remover acids preferred for use herein are selected from water-soluble organic mono- and polycarboxylic acids with two to six carbon atoms in the molecule and optionally substituted by one or more hydroxy groups. Suitable classes of limescale remover include alkanoic acids, hydroxyalkanioc acids, alkyl polycarboxylic acids and hydroxyalkyl polycarboxylic acids. Preferred herein are mono- and polycarboxylic acids which have a pKa value, related to the first dissociation stage of less than about 6. These include for example, adipic acid, succinic acid, tartaric acid, malic acid, glutaric acid, citric acid and mixtures thereof. Citric acid being highly preferred.

Inorganic acids and mixtures of inorganic acids and organic acids can also be used as the limescale remover component. The inorganic acids are specially usefull when mixed with organic acids. Examples of inorganic acids are sulphonic acid derivatives, sulphamic acid (pKa=0.1), hydrochloric acid (pKa<0), nitric acid (pKa<0), phosphoric acid (pKa=2.1) and sulphuric acid (pKa=0.4). Suitable sulphonic acid derivatives include alkyl sulphonic acids and aryl sulphonic acids. Suitable alkyl sulphonic acids include C1–C6 linear or branched alkylsulphonic acids or mixtures thereof, such as methanesulphonic acid (pKa=1.9) commercially available for example from Aldrich, William Blythe & Co. Ltd. or Elf. Atochem.

Suitable aryl sulphonic acids for use herein include those of the formula:

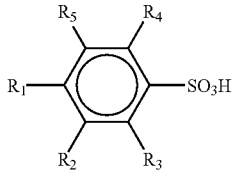

wherein R1, R2, R3, R4 and R5 are each H or $SO_3H$, or linear or branched C0–C4 alkyl chain; or mixtures thereof.

Preferred arylsulphonic acids to be used are those which comprise no or only one alkyl chain. Indeed, arylsulphonic acids are particularly effective at removing limescale, which is not the case for their longer alkyl chain homologues. Also arylsulphonic acids are particularly safe to the surface treated therewith. Particularly suitable arylsulphonic acids for use herein are benzene sulphonic acid (pKa=0.7), toluene sulphonic acid and cumene sulphonic acid. Amongst these three, at equal weight %, the shorter the alkyl chain, down to no chain at all, the better the limescale removing performance.

Suitable nonionic surfactants according to the present invention includes nonionic alkoxylated surfactants (especially ethoxylates derived from $C_6$–$C_{18}$ primary alcohols), ethoxylated-propoxylated alcohols (e.g., Olin Corporation's Poly-Tergent® SLF18), epoxy-capped poly(oxyalkylated) alcohols (e.g., Olin Corporation's Poly-Tergent® SLF18B—see WO-A-94/22800), ether-capped poly(oxyalkylated) alcohol surfactants, and block polyoxyethylene-polyoxypropylene polymeric compounds such as PLURONIC ®, REVERSED PLURONIC®, and TETRONIC® by the BASF-Wyandotte Corp., Wyandotte, Mich. Surfactants suitable herein are disclosed, for example, in U.S. Pat. Nos. 3,929,678, 4,259,217, EP-A-0414 549, WO-A-93/08876 and WO-A-93/08874.

The nonionic surfactants are typically present at a level of from about 1% to about 20% by weight, more preferably from about 2% to about 18% by weight, most preferably from about 4% to about 15% by weight of composition.

Enzymes suitable herein include proteases such as Esperase$^R$, Alcalase$^R$, Durazym$^R$ and Savinase$^R$ (Novo) and Maxatase$^R$, Maxacal$^R$, Properase$^R$ and Maxapem$^R$ (Gist-Brocades); and α and β amylases such as Purafect Ox Am$^R$ (Genencor) and Termamyl$^R$, Ban$^R$, Fungamyl$^R$, Duramyl$^R$, Amylase AG$^R$ and Natalase$^R$ (Novo); and mixtures thereof. Enzymes are preferably added herein as prills, granulates, or cogranulates at levels typically in the range from about 0.5% to about 5% pure enzyme by weight of composition. In a preferred embodiment of the present invention Termamyl$^R$ is used.

Amylases (α and/or β) can be included for removal of carbohydrate-based residues. WO-A-94/02597 describes cleaning compositions which incorporate mutant amylases. See also WO-A-95/10603. Other amylases known for use in cleaning compositions include both α- and β-amylases. α-Amylases are known in the art and include those disclosed in U.S. Pat. No. 5,003,257; EP-A-0252,666; WO-A-91/00353; FR-A-2,676,456; EP-A-0285,123; EP-A-525,610; EP-A-0368,341; and GB-A-1,296,839. Other suitable amylases are stability-enhanced amylases described in WO-A-94/18314 and WO-A-96/05295 and amylase variants having additional modification in the immediate parent available from Novo Nordisk A/S, disclosed in WO-A-95/10603. Also suitable are amylases described in EP-A-0277216, WO-A-95/26397 and WO-A-96/23873.

Examples of commercial α-amylases products are Purafect Ox Am® from Genencor and Termamyl®, Ban®, Fungamyl® and Duramyl®, Natalase® and Amylase AG® all available from Novo Nordisk A/S Denmark. WO-A-95/26397 describes other suitable amylases: α-amylases characterised by having a specific activity at least 25% higher than the specific activity of Termamyl® at a temperature range of 25° C. to 55° C. and at a pH value in the range of 8 to 10, measured by the Phadebas® α-amylase activity assay. Suitable are variants of the above enzymes, described in WO-A-96/23873. Other amylolytic enzymes with improved properties with respect to the activity level and the combination of thermostability and a higher activity level are described in WO-A-95/35382.

The cleaning tablet of the invention can also contain carbohydrase and gluconase enzymes. Carbohydrase enzymes are those enzymes which catalyse the hydrolysis of carbohydrate polymers, including disaccharides, to respectively smaller polymers and mono-saccharides. Glucanase enzymes are those enzymes which catalyze the breakdown of glucan. Glucan is a polysaccharide composed of the hexose, sugar, d-glucose. These enzymes are active in the pH range 2 to 5 and are capable of catalyzing the breakdown of sugar based biopolymers. A variety of carbohydrases and glucanases are available commercially. Preferred carbohydrases and glucanases are manufactured by Novo Nordisk Industry under the tradename VISCOZYME®. Similar enzymes from other commercial sources would be equally acceptable.

Other suitables enzymes for use herein are pectinases (produced from a selected strain of *Aspergillus niger*) available from Novo Nordisk Industry under the tradename of Pectinex, including Pectinex 1×L, Pectinex 3×L and Pectinex 5×L as well as Peelzym™.

The above-mentioned enzymes may be of any suitable origin, such as vegetable, animal, bacterial, fungal and yeast origin. Origin can further be mesophilic or extremophilic (psychrophilic, psychrotrophic, thermophilic, barophilic, alkalophilic, acidophilic, halophilic, etc.). Purified or non-purified forms of these enzymes may be used. Also included by definition, are mutants of native enzymes. Mutants can be obtained e.g. by protein and/or genetic engineering, chemical and/or physical modifications of native enzymes. Common practice as well is the expression of the enzyme via host organisms in which the genetic material responsible for the production of the enzyme has been cloned.

An additional component of the present invention is a carrier for the non-ionic surfactant in a level from 10% to 50% by weight. The carrier is preferably porous, adsorbent and able to provide an acidic pH when the tablet is dissolved in the wash-liquor. The carrier can be acidic, neutral or slightly alkaline. A carrier providing a pH lower than 9, measured as 1% solution in distilled water at 20° C., is preferred. The particle size of the carrier is a critical parameter for the strength of the tablet. In one preferred embodiment sodium sulphate is used, since it is cheap and easily available.

Other suitable components herein include one or more components selected from: builders, aesthetic agents, polymeric dispersants, disrupting agents, binders, shine improvement agents, residuality improvement agents and mixtures thereof.

The tablets are prepared by admixing of the granular and liquid components and compression of this mixture using a tablet press. In a preferred embodiment, the non-ionic surfactant and the carrier can be preagglomerated before mixing with the rest of the components.

EXAMPLES

Abbreviations used in Examples

In the cleaning compositions, the abbreviated component identifications have the following meanings:

| | |
|---|---|
| Citric Acid | Anhydrous Citric acid (313 μm) |
| LF404 | $C_{13}$–$C_{15}$ mixed ethoxylated/propoxylated fatty alcohol with an average degree of ethoxylation of 3.8 and an average degree of propoxylation of 4.5, sold under the tradename Plurafac by BASF |
| PEG 8000 | Polyethylene Glycol molecular weight approximately 8000 available from Hoechst |
| Savinase ® | α-amylase available from Novo Nordisk A/S |
| Sulphate | Sodium sulphate (30 μm) |
| Termamyl ® | α-amylase available from Novo Nordisk A/S |

In the following examples all levels are quoted as percent by weight.

Examples I–IV

The following illustrates example detergent tablets of the present invention suitable for use in a dishwashing machine. The compositions are prepared by premixing all the components and compressing the mixture in a tablet press.

| | I | II | III | IV |
|---|---|---|---|---|
| Components | | | | |
| Citric Acid | 55 | 50 | 55 | 55 |
| LF404 | 5 | 6 | 5 | 5 |
| PEG 8000 | 5 | 7 | 5 | 6 |
| Savinase ® | | | 1.5 | 0.75 |
| Sulphate | 33 | 35 | 33 | 33 |
| Termamyl ® | 1.5 | 1 | | |
| Perfume | 0.5 | 1 | 0.5 | 0.25 |

Tablets of the above compositions are placed in the cutlery basket of a Bosch dishwasher and the machine is run unloaded. The tablets provide excellent cleaning performance on dishwasher filters as well as excellent limescale removal.

The invention claimed is:

1. A machine cleaner tablet comprising:

a) from about 40% to about 75%, by weight of the tablet, of a limescale remover acid;

b) from about 1% to about 20%, by weight of the tablet, of low foaming non-ionic surfactant said surfactant being preagglomerated with a surfactant carrier comprising sodium sulfate having a weight average particle size less than about 70 μm;

c) from about 0.5% to about 5%, by weight of the tablet, of a detergency enzyme; and wherein the tablet has a pH measured as a 1% solution in distilled water at 20° C. in the range of from about 1 to about 5.

2. A tablet according to claim 1 wherein the limescale remover acid is selected from the group consisting of water soluble organic mono- and polycarboxylic acids with two to six carbon atoms in the molecule and which has a pKa value, related to the first dissociation stage of less than about 6.

3. A tablet according to claim 1 wherein the average particle size of the limescale remover is from about 100 μm to about 500 μm.

4. A tablet according to claim 1 wherein the non-ionic surfactant is selected from the group consisting of: poly (oxyalkylated) alcohols, end-capped poly(oxyalkylated) alcohols, alkylene oxide condensates with propylene glycol or alkylene diamine adducts, and mixtures thereof.

5. A tablet according to claim 4 wherein the non-ionic surfactant is present in a level of from about 2% to about 18%, by weight of the tablet.

6. A tablet according to claim 5 wherein the non-ionic surfactant is present in a level of from about 4% to about 15% by weight of the tablet.

7. A tablet according to claim 1 wherein the enzyme has an optimum enzyme activity in the pH range from about 5 to about 11.

8. A tablet according to claim 7 wherein the enzyme has an optimum enzyme activity in the pH range of from about 7 to about 10.

9. A tablet according to claim 7 wherein the enzyme is selected from proteases. α-amylases and mixtures thereof.

10. A tablet according to claim 9 wherein the enzyme is an α-amylase derived from *Bacillus licheniformis*.

11. A tablet according to claim 1 wherein the tablet further comprises at least one additional component selected from the group consisting of builders, aesthetic agents, polymeric dispersants, disrupting agents, binders, shine improvement agents, residuality improvement agents and mixtures thereof.

12. A tablet according to claim 1 wherein the tablet comprises from about 10% to about 50%, by weight of the tablet, of said sodium sulfate surfactant carrier.

13. A tablet according to claim 12 wherein the said surfactant carrier has a weight average particulate size of less than about 20 μm.

14. A method of manufacturing a tablet according to claim 1 comprising the steps of preagglomerating the non-ionic surfactant and sodium sulfate surfactant carrier, admixing the limescale remover acid and detergency enzyme and compacting the mixture in a tablet press.

15. A method for cleaning dishwashers and washing machines, said method comprising placing a tablet according to claim 1 in the interior of the machine and running a high or a low temperature wash program, in the absence of a dishwashing load.

* * * * *